United States Patent [19]

Devaux

[11] Patent Number: 4,591,321

[45] Date of Patent: May 27, 1986

[54] METHOD AND APPARATUS FOR REMOVING PRESSURE PEAKS AND DAMPING HYDRAULIC PRESSURE WAVES AND PEAKS FROM PRESSURE VARIATIONS IN THE FEED DUCTS OF A HYDRAULIC PUMP AND A PUMP FOR IMPLEMENTING THE METHOD

[75] Inventor: Alain Devaux, Saint Mande, France

[73] Assignee: Societe d'Etudes de Machines Thermiques S.E.M.T., S.A., Saint Denis, France

[21] Appl. No.: 716,674

[22] Filed: Mar. 27, 1985

[30] Foreign Application Priority Data

Mar. 29, 1984 [FR] France ..... 84 04904

[51] Int. Cl.[4] ..... F02M 59/44

[52] U.S. Cl. ..... 417/499; 123/447

[58] Field of Search ..... 417/494, 499; 123/447, 123/467, 506

[56] References Cited

U.S. PATENT DOCUMENTS 1,993,759 3/1935 Stockmeyer ..... 417/494
4,526,149 7/1985 Hafele et al. ..... 123/447
4,526,150 7/1985 Guntert et al. ..... 123/447

FOREIGN PATENT DOCUMENTS 468958 7/1937 United Kingdom ..... 123/447

*Primary Examiner*—Leonard E. Smith
*Attorney, Agent, or Firm*—Kenyon & Kenyon

[57] ABSTRACT

A method of damping hydraulic pressure waves and of removing peaks from pressure variations in the feed ducts of a hydraulic pump resulting from excess fluid returned with high kinetic energy to a feed chamber uses this kinetic energy directly to increase temporarily the volume of the feed chamber by a value lying in the range 10% to 30% of the maximum cylinder capacity of the hydraulic pump. The pump has a resiliently movable wall disposed in a feed chamber perpendicularly to the direction of a high kinetic energy jet of fluid from a passageway opening into the chamber. The wall is located on the axis of the passageway at a distance from the opening that is not more than 1.5 times the smallest diameter of the passageway. The invention also relates to a hydraulic pump for implementing the method. Applicable to fuel injection pumps in Diesel engines.

13 Claims, 3 Drawing Figures

METHOD AND APPARATUS FOR REMOVING PRESSURE PEAKS AND DAMPING HYDRAULIC PRESSURE WAVES AND PEAKS FROM PRESSURE VARIATIONS IN THE FEED DUCTS OF A HYDRAULIC PUMP AND A PUMP FOR IMPLEMENTING THE METHOD

The present invention relates to a method of damping hydraulic pressure waves and of removing the peaks from the pressure variations in the feed ducts of a hydraulic pump, together with apparature for implementing the method in a hydraulic pump, which may, for example, be a fuel injection pump or a pump for controlling the positioning of hydraulic jacks.

In a variable flowrate hydraulic pump having a working chamber supplied from a feed chamber and fitted with a piston having a rectilinear and constant stroke, in which a ridge on the piston cooperates in a selectively variable manner at the end of delivery with a hole for putting the working chamber in communication with the feed chamber to return undelivered liquid to the feed chamber, the sudden pressure drop which accompanies the end of delivery generates pressure waves which travel up the, or each, feed duct to the feed chamber. These pressure waves may damage various components, such as filters and monitoring instruments, for example:

One known method of limiting pressure waves and of reducing the peaks in the pressure variations consists in placing pressure accumulators in the feed ducts or on the body of the pump. However, their inertia does not provide satisfactory removal of the peak variations, and the fluid used may be of such a nature (chemically aggressive or at high temeprature) which makes their lifetime very unpredictable. The capacity of such accumulators frequently reaches 200% of the maximum cylinder capacity of the pump.

British patient specification No. 468 958 describes a device for damping hydraulic pressure waves and for removing peaks from pressure variations, the device is constituted by a resiliently moving wall which is disposed normally to the direction of the fluid jet, but this device is installed on a pump provided with a feed chamber which does not communicate directly with the device such that the feed hole from the feed chamber to the working chamber is distinct from the delivery hole to the device. This device thus performs the role of a conventional accumulator for absorbing the major portion of the quantity of fuel which is delivered at low load. The increase in volume is then very large, and further, in its rest position the moving wall is very far removed from the working chamber so that it does not effectively absorb the kinetic energy of the fluid.

The aim of the present invention is to damp shock waves and to remove peaks in pressure variations without using large accumulator capacities, but by directly transferring the kinetic energy of the fluid to a resiliently moving wall.

The present invention provides a method of damping hydraulic pressure waves and of removing peaks from pressure variations in the feed ducts of a hydraulic pump fitted with a feed chamber that supplies fluid to and receives excess fluid at high kinetic energy from a working chamber, the method being characterized in that this kinetic energy is directly used to temporarily increase the volume of the feed chamber by a value in the range 10% to 30% of the maximum cylinder capacity of the hydraulic pump.

The present invention also provides a hydraulic pump for performing the method according to claim 1, the pump comprising a feed chamber supplied from at least one feed duct, a piston having a rectilinear and constant stroke inside a working chamber and provided with at least one ridge which, in a selectively variable manner, adjusts the end of the delivery process from the pump by cooperating with at least one passageway for putting the working chamber into communication with the feed chamber before the end of the piston stroke to return excess fluid from the working chamber to the feed chamber during the remainder of the piston stroke, at least one device for damping hydraulic pressure waves and for removing peaks from pressure variations, constituted by a resiliently movable wall disposed normally to the direction of the fluid jet entering the feed chamber from said passageway, characterized in that the wall is situated in the feed chamber on the axis of the passageway at a distance from the opening of the passageway which does not exceed 1.5 times the smallest diameter of the passageway.

Advantageously, the moving wall of the device is a part of a hermetically closed and deformable enclosure which is mechanically limited in expansion and in compression, and which contains a gas under pressure that is optionally accompanied by a liquid and/or a spring, a portion of the deformable enclosure being constituted by a cylindrical tube having a corrugated wall, the corrugations enabling deformation along its axis.

Preferably, the moving wall of the device constitutes a low inertia piston which partially closes a housing containing the enclosure, with grooves and/or holes provided in the piston or in the wall of the housing putting the housing in communication with the feed chamber.

A hydraulic pump in accordance with the invention and which is a fuel injection pump is described below by way of example with reference to the accompanying drawings.

Figure 1:
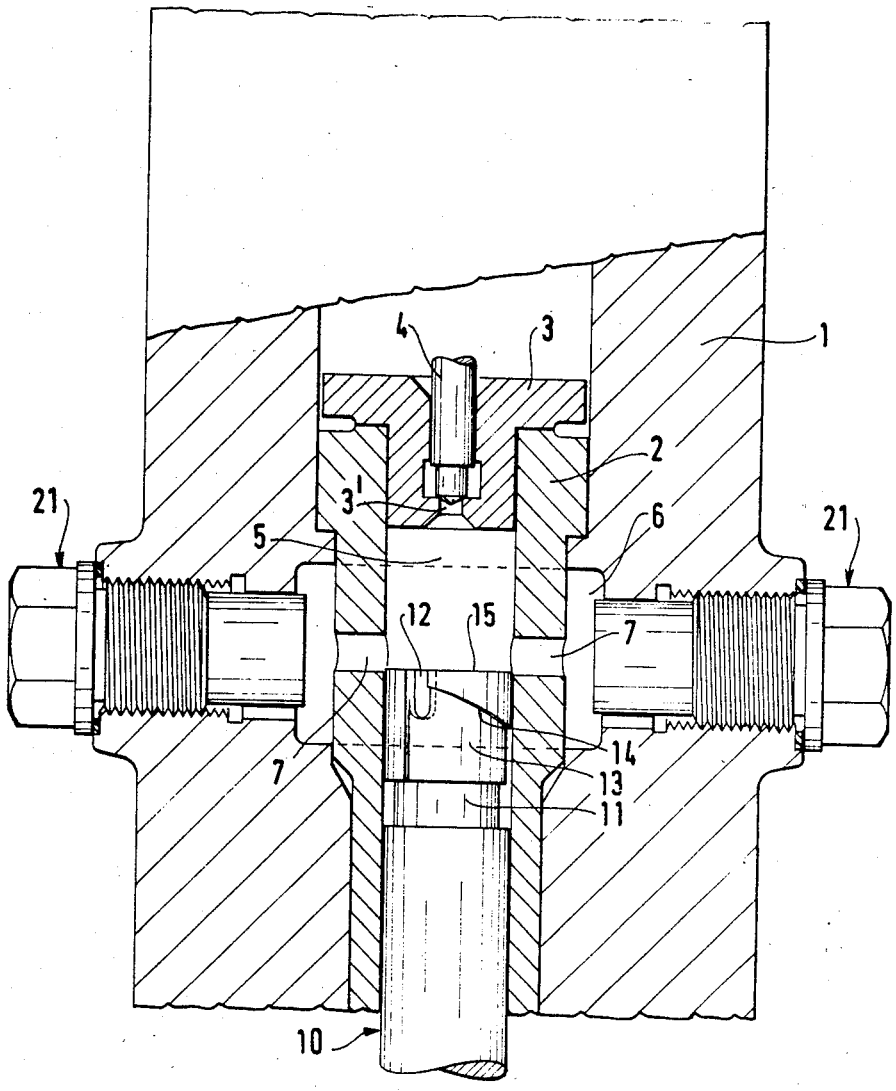
FIG. 1 is a diagrammatic view showing the injection pump fitted with two damping and peak removal devices.

FIG. 1 shows the body of a pump 1, a cylinder 2 fixed in known manner in the body 1, a head 3 including a non-return valve 4 which closes an orifice 3', a piston 10 which delimits a working chamber 5 between its top face 15 and the head 3, an annular feed chamber 6, also referred to as a collector chamber 6, which is put into communication with the working chamber 5 via two passageways 7, and finally two tubular bodies 21 each of which encloses a damping and peak removal device, each of said two bodies opening out into the collector chamber 6 on the axis of one of the passageways 7.

Naturally, the fuel injection pump need include only one passageway and associated device, but generally a fuel injection pump comprises two passageways 7 which are diametrically opposed in order to avoid subjecting the piston to side loading due to hydraulic thrust.

The piston 10 includes a neck 11, vertical groove 12, another vertical groove which is diametrically opposite and not shown, a hollow 13 which delimits an oblique ridge 14, and another hollow delimiting another oblique ridge not shown.

The piston 10 is driven vertically in the cylinder 2 by means of a cam (not shown) and performs a compression stroke when moving upwards and a suction stroke when moving downwards. In addition, a rack (not shown) meshed with teeth in a part connected to the piston sets the angular position of the piston and serves to modify the instant at which injection ends by means of the oblique ridges.

Figure 2:
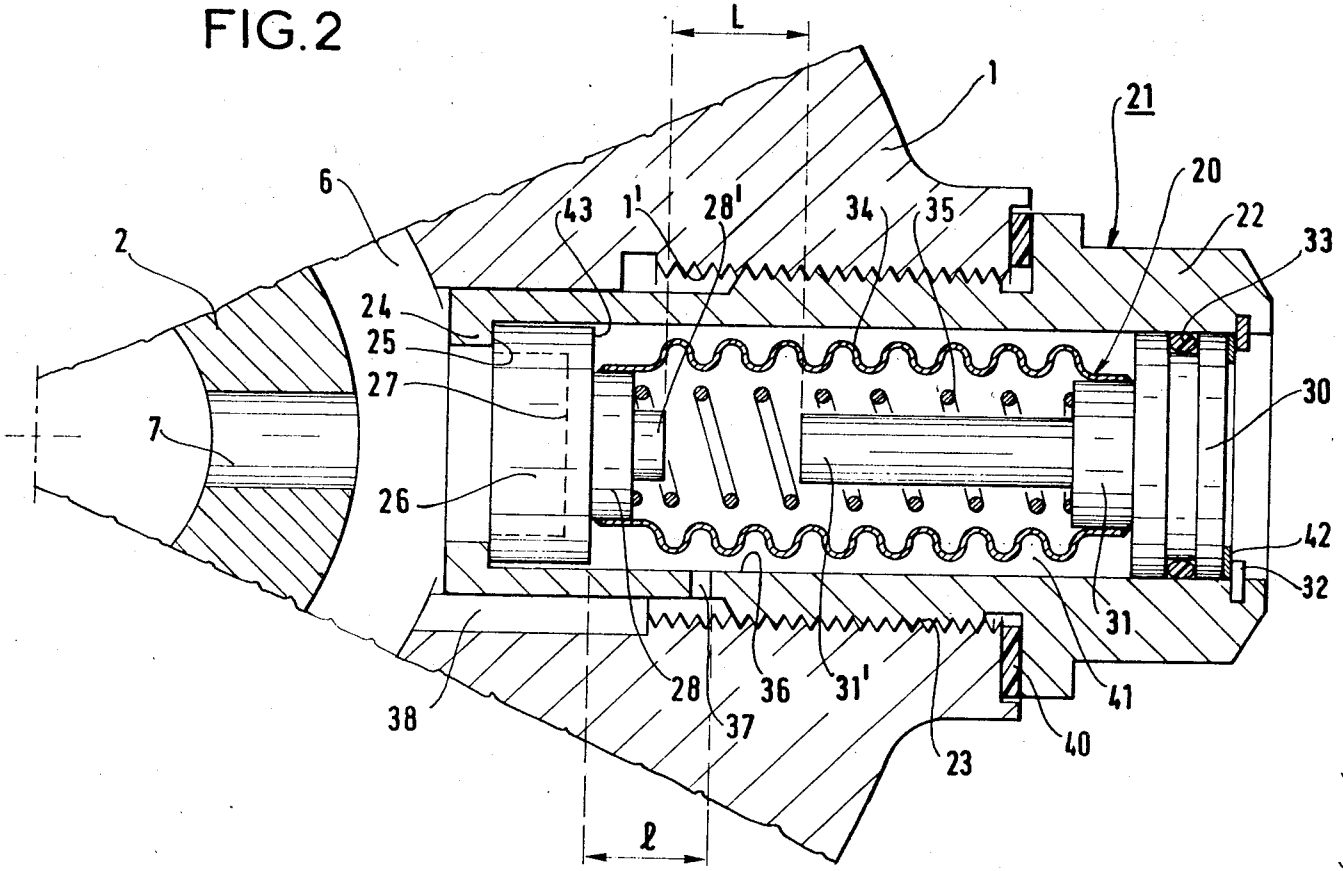
FIG. 2 is a detailed view of a damping and peak removal device.

One of the devices 20 opening out into the collector chamber 6 opposite a passageway 7 is shown in greater detail in FIG. 2 which also shows the cylinder 2 and one of its passageways 7.

The device 20 is installed on a tubular body 21 including a bore 36, an outside head 22, e.g. in the form of a hexagonal nut to enable the device to be screwed tight, a thread 23 cooperating with a tapping 1' in the body of the pump 1, and an end 24 provided with a shoulder 25 which constitutes a stop. A gasket 40 is interposed between the head 22 and the body of the pump 1.

Naturally, the presence of the tubular body 21 is optional, and the bore 36 with its shoulder 25 may be directly machined in the body of the pump 1.

The device 20 comprises a piston 26 which is free to move in the bore 36, a stopper 30 which is prevented from moving in translation by means of a stop ring 32 and which is provided with a sealing ring 33 for sealing the stopper 30 to the bore 36. A variable number of variable thickness shims 42 serve to modify the rest distance between the piston 26 and the stopper 30. A cylindrical tube 34 having a corrugated wall is connected in sealed manner to the stopper 30 and to the piston 26 via shoulders 31 and 28.

The cylindrical tube 34, the shoulder 28 of the piston 26, and the shoulder 31 of the piston 30 constitute an enclosure which is hermetically sealed, which is deformable, and which is situated inside the bore 36 of the tubular body 21. This enclosure is mechanically limited in expansion by the shoulder 25 and the stop ring 32 and is mechanically limited in compression since the internal shoulders 28 and 31 of the piston 26 and of the stopper 30 are fitted with stops 28' and 31'. These two stops also serve as a guide for a spring 35 which bears against the shoulders 28 and 31. The presence of the spring is not essential, since the hermetically closed and deformable enclosure contains a gas under pressure, which may optionally be accompanied by a liquid for modifying the stiffness of the damper constituted by the gas alone, or by the gas-spring combination.

The piston 26 includes an outer wall or face 27 which is plane or concave and which is advantageously made abrasion resistant by suitable surface treatment such as a deposit of ceramic material. When the piston 26 abuts against the shoulder 25, this face 27 should be at a distance from the passageway which does not exceed 1.5 times the smallest diameter of the passageway.

As shown in FIG. 2, the tubular body 21 includes an orifice 37, and the body of the pump 1 includes a groove 38, the orifice 37 and the groove 38 put the volume 41 existing between the bore 36, the tube 34, the piston 26, and the stopper 30 into communication with the collector chamber 6. The orifice 36 is provided at a distance 1 from the face 43 of the piston 26 when the piston is at rest on the shoulder 25. This distance 1 is slightly less than the distance L which separates the two stops 28' and 31' when they are at rest, and thus when the piston 26 moves backwards, the orifice 37 is closed prior to the mechanical stops coming into abutment, thereby increasing the pressure of the fuel enclosed in the volume 41 and thus providing a hydraulic stop.

Figure 3:
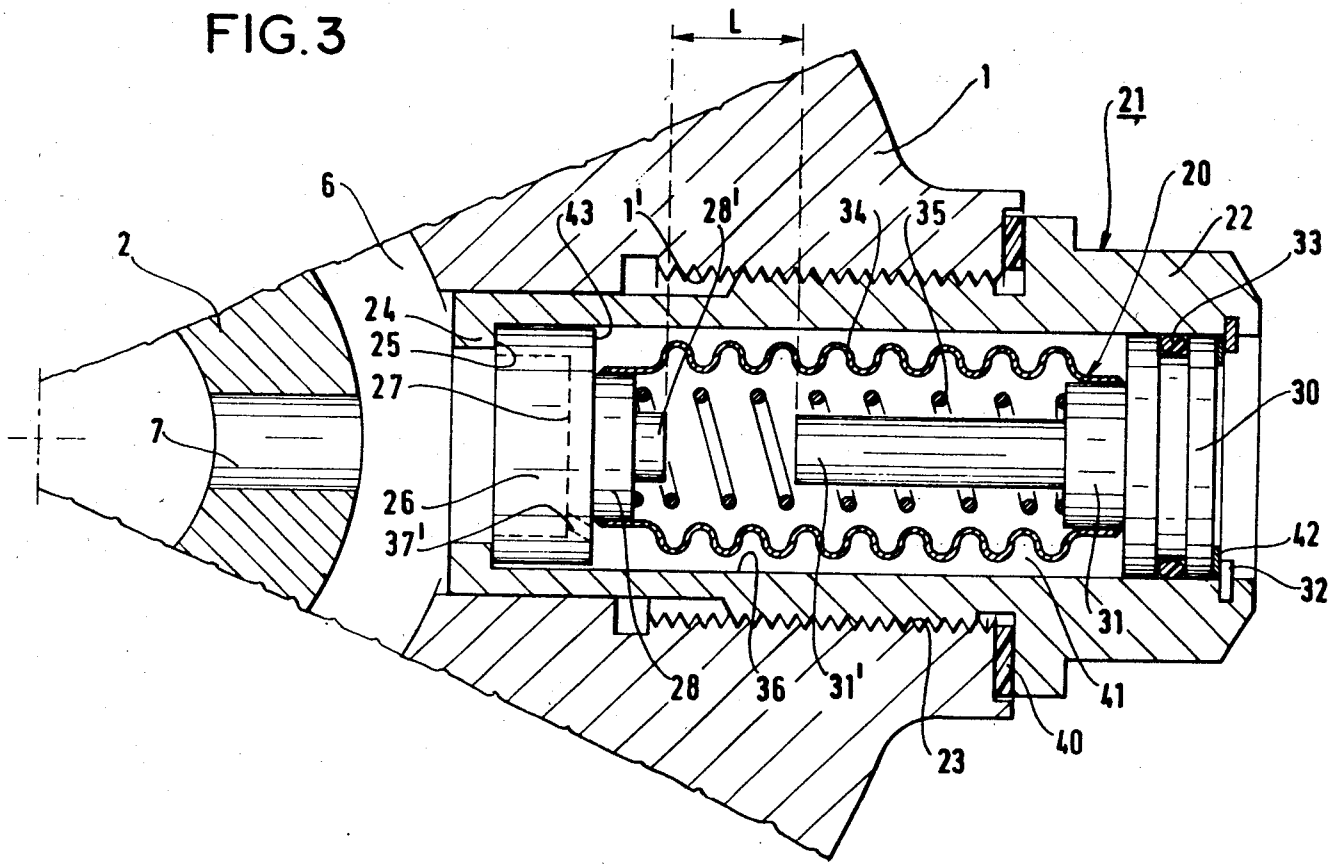
FIG. 3 is a detailed view of an alternative embodiment of a damping and peak removal device.

In accordance with a variant of the invention, as shown in FIG. 3, an orifice 37' may be provided directly in the piston 26 and, in this case, the groove 38 and the orifice 37 may be omitted.

A damping and peak removal operation takes place as follows:

At the beginning of the decompression phase, i.e. at the instant when the ridges 14 of the piston 10 open the passageway 7, the momentum of the fuel leaving the passaeway 7 is immediately transformed into potential energy by the piston 26 which compresses the gas and/or the spring in the device 20, thereby preventing pressure waves from propagating outside the collector chamber 6. The piston is then returned by the gas and/or the spring towards the stop 25. The progressive release of the potential energy stored in the device 20 is controlled by exchanging a quantity of fuel between the volume 41 and the collector chamber 6 via the orifices 37, 38 and/or 37', and/or the clearance between the piston 26 and the bore 36.

The variation in the volume of the collector chamber 6 caused by the displacement of the piston lies in the range 10% to 30% of the maximum cylinder capacity of the injection pump. The shims 42 enable the pre-stress applied to the device 20 to be adjusted if needed.

The kinetic energy is available at the outlet from the passageway 7 in the form of a small mass of fuel moving at very high speed. The shock which occurs against the face 27 of the piston 26 causes considerable erosion. The use of suitable processing for increasing the abrasion resistance of the face 27 serves to limit the consequences of this phenomenon.

The advantage of using a sealed accumulator enclosure such as the device 20 is that there is no need to provide sealing between the piston 26 and the bore 36, which seal would have an unpredictable lifetime and would be a major source of friction. At the moment of kinetic energy absorption, this friction loss would be added to the inertia due to the mass of the piston 26 whose resistance to movement should, on the contrary, be very low.

I claim:

1. A method of removing pressure peaks and damping hydraulic pressure oscillations in a feed duct supplying hydraulic fluid to a positive displacement hydraulic pump, the pump having a feed chamber open to the feed duct and the pressure peaks and oscillations resulting from the periodic return of high energy jets of excess fluid from a working chamber of the pump to the feed chamber, the method comprising:

directly absorbing at least part of the kinetic energy of each jet by temporarily increasing the volume of the feed chamber by a total value of from 10% to 30% of the maximum capacity of the working chamber.

2. The method of claim 1 wherein the step of absorbing the kinetic energy of each jet by temporarily increasing the volume of the feed chamber comprises:

transforming the kinetic energy of each jet into potential energy stored upon movement of a resiliently biased movable wall portion of the feed chamber to a position defining an increased volume of the feed chamber and progressively returning the movable wall portion to a position defining an unexpanded volume of the feed chamber.

3. The method of claim 1 wherein the step of absorbing the kinetic energy of each jet by temporarily increasing the volume of the feed chamber comprises:

directing each jet from an opening of a passageway from the working chamber into the feed chamber toward a resiliently biased movable wall portion of the feed chamber disposed on the axis of the jet at a distance from said opening that does not exceed 1.5 times the smallest diameter of the passageway.

4. Apparatus for removing pressure peaks and for damping hydraulic pressure oscillations in a feed duct for supplying hydraulic fluid to a variable volume positive displacement hydraulic pump that includes a feed chamber open to the feed duct, a working chamber, a fixed stroke piston disposed inside the working chamber, at least one passageway having a first opening in the working chamber and a second opening in the feed chamber, the piston having means for selectively uncovering the first opening to deliver a jet of excess hydraulic fluid at the end of a stroke from the working chamber through the second opening of the passageway at high velocity into the working chamber, wherein the apparatus comprises:

at least one resiliently biased movable wall disposed in the feed chamber, each wall being positioned transversely to the direction of the fluid jet on the axis of the second opening of the corresponding passageway at a distance from said second opening that does not exceed 1.5 times the smallest diameter of the passageway, and wherein the at least one movable wall is capable of increasing the volume of the feed chamber by a total value of from 10% to 30% of the maximum capacity of the working chamber upon absorbing the energy of the respective at least one jet of excess hydraulic fluid.

5. The apparatus of claim 4 wherein said movable wall comprises a part of a hermetically closed deformable enclosure containing gas under pressure, the apparatus further comprising means for mechanically limiting the expansion and contraction of said deformable enclosure.

6. The apparatus of claim 5 wherein said deformable enclosure contains a spring for resiliently opposing contraction of the enclosure.

7. The apparatus of claim 5 or 6 wherein said deformable enclosure contains a liquid.

8. The apparatus of claim 5 or 6 wherein said deformable chamber comprises a cylindrical tube having a corrugated wall, the corrugations enabling deformation of the chamber along the axis of the tube.

9. The appartus of claim 5 or 6, further comprising a housing containing said deformable enclosure, the housing having an open end facing the feed chamber, wherein said movable wall comprises a low inertia piston which partially closes the open end of the housing when the deformable enclosure is fully expanded.

10. The apparatus of claim 9 wherein said piston includes means for communicating the feed chamber with the space between the deformable enclosure and the interior of the housing.

11. The apparatus of claim 9 wherein the housing includes means for communicating the interior of the housing with the feed chamber.

12. The apparatus of claim 5 or 6, further comprising means for selectively adjusting the initial resilience of said movable wall.

13. The apparatus according to one of claims 4 to 6 wherein said hydraulic pump is a fuel injection pump.

* * * * *